US009153889B2

(12) United States Patent
Germ et al.

(10) Patent No.: US 9,153,889 B2
(45) Date of Patent: Oct. 6, 2015

(54) ELECTRICAL CONNECTOR SYSTEM CONNECTABLE IN A STRAIGHT OR RIGHT ANGLE CONFIGURATION

(71) Applicant: DELPHI TECHNOLOGIES, INC., Troy, MI (US)

(72) Inventors: Kenneth B. Germ, Niles, OH (US); Troy A. Iler, Salem, OH (US); William C. Ketterer, Girard, OH (US); Don E. Bizon, Boardman, OH (US)

(73) Assignee: Delphi Technologies, Inc., Troy, MI (US)

( * ) Notice: Subject to any disclaimer, the term of this patent is extended or adjusted under 35 U.S.C. 154(b) by 31 days.

(21) Appl. No.: 14/150,136

(22) Filed: Jan. 8, 2014

(65) Prior Publication Data

US 2014/0302702 A1 Oct. 9, 2014

Related U.S. Application Data

(60) Provisional application No. 61/809,976, filed on Apr. 9, 2013.

(51) Int. Cl.
*H01R 4/32* (2006.01)
*H01R 13/02* (2006.01)
(Continued)

(52) U.S. Cl.
CPC ..... *H01R 13/02* (2013.01); *H01R 13/113* (2013.01); *H01R 13/639* (2013.01); *H01R 13/35* (2013.01); *H01R 13/6273* (2013.01); *H01R 13/641* (2013.01)

(58) Field of Classification Search
CPC .... H01R 4/32; H01R 13/113; H01R 13/6272; H01R 13/6275
USPC ..... 439/224, 222, 217, 352, 489, 518, 446, 439/170, 173, 172, 31, 347
See application file for complete search history.

(56) References Cited

U.S. PATENT DOCUMENTS

| | | | | |
|---|---|---|---|---|
| 4,655,522 | A * | 4/1987 | Beck et al. | 439/224 |
| 7,758,369 | B2 * | 7/2010 | Miller et al. | 439/352 |
| 2003/0194919 | A1 | 10/2003 | Hsieh et al. | |

FOREIGN PATENT DOCUMENTS

| | | | |
|---|---|---|---|
| DE | 196 17 819 | A1 | 11/1997 |
| EP | 2 006 958 | A2 | 12/2008 |
| WO | 03/028160 | A2 | 4/2003 |

OTHER PUBLICATIONS

European Search Report dated Jun. 20, 2014.

*Primary Examiner* — Abdullah Riyami
*Assistant Examiner* — Nelson R Burgos-Guntin
(74) *Attorney, Agent, or Firm* — Robert J. Myers

(57) ABSTRACT

An electrical connector system having a male and female connector. The male connector includes a U-shaped shroud axially surrounding a male terminal having an opening generally perpendicular to the male terminal's longitudinal axis. The female connector includes a female terminal having two openings, one generally parallel with the female terminal's longitudinal axis and another generally perpendicular to that axis. The male and female terminals mate in a parallel configuration having the male terminal axis generally parallel to the female terminal axis or in a perpendicular configuration having the male terminal axis generally perpendicular to the female terminal axis. A connector body holds the female terminal. The connector body defines a locking means that releasably secures the connector body to the shroud in both the parallel and perpendicular mating configurations. The locking means may include a triangular shaped lock tab that engages a similarly shaped lock aperture.

16 Claims, 10 Drawing Sheets

(51) Int. Cl.

| | | | |
|---|---|---|---|
| ***H01R 13/11*** | (2006.01) | *H01R 13/35* | (2006.01) |
| ***H01R 13/639*** | (2006.01) | *H01R 13/627* | (2006.01) |
| | | *H01R 13/641* | (2006.01) |

ELECTRICAL CONNECTOR SYSTEM CONNECTABLE IN A STRAIGHT OR RIGHT ANGLE CONFIGURATION

CROSS-REFERENCE TO RELATED APPLICATION

This application claims the benefit under 35 U.S.C. §119 (e) of U.S. Provisional Patent Application No. 61/809,976 that was filed Apr. 9, 2013, the entire disclosure of which is hereby incorporated herein by reference.

TECHNICAL FIELD OF THE INVENTION

The invention generally relates to electrical connectors, and more particularly relates to a connector system that may be connected in either a straight or right angle configuration.

BACKGROUND OF THE INVENTION

Electrical connection systems may have a wide variety of applications. Some applications may require a straight connection wherein the major axes of the connectors are generally parallel to one another while other applications require a ninety-degree connection wherein the major axes of the connectors are generally perpendicular to one another. Typically these different connector alignments require two different sets of connectors, one set configured for straight connections and a second set configured for ninety-degree connections. Requiring two different sets of connectors may increase manufacturing cost by necessitating two different sets of manufacturing tooling for each set of connectors.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical connector system is provided. The electrical connector system comprises a male connector and a female connector. The male connector includes a male terminal and a U-shaped shroud axially surrounding the male terminal, wherein the shroud defines an opening generally perpendicular to a male terminal longitudinal axis. The female connector includes a female terminal defining a first terminal opening generally parallel with a female terminal longitudinal axis and a second terminal opening generally perpendicular to the female terminal longitudinal axis. The female terminal is configured to mate with the male terminal in a parallel mating configuration having the male terminal longitudinal axis generally parallel to the female terminal longitudinal axis. The female terminal is also configured to mate with the male terminal in a perpendicular mating configuration having the male terminal longitudinal axis generally perpendicular to the female terminal longitudinal axis. The female connector further includes a connector body that holds the female terminal. The connector body defines a locking means configured to releasably secure the connector body to the shroud in both the parallel mating configuration and the perpendicular mating configuration.

According to other embodiments of the invention a male connector and a female connector are provided.

The shroud may defines a lock aperture and the locking means may include a resilient lock tab configured to engage the lock aperture, thereby securing the connector body to the shroud in the parallel mating configuration and in the perpendicular mating configuration. The lock tab defines a shape having 90 degrees of rotational symmetry. The lock tab and the lock aperture may be characterized as having a generally isosceles right triangle shape. The connector body may include a resilient cantilever beam defining the lock tab. The lock tab is proximate a free end of the cantilever beam. The connector body may further comprises a connector position assurance device including an arm configured to slide behind the cantilever beam, thereby inhibiting inward flexing of said cantilever beam.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

Similar components in the various embodiments are identified in the Figures by reference numbers having the same last two digits.

DETAILED DESCRIPTION OF THE INVENTION

An electrical connector system is presented herein that allows a male connector and a female connector to be connected in either a straight or ninety-degree connection configuration. This electrical connector system allows a wider application the connector system than connector systems requiring separate connectors for straight connections and ninety-degree connections. The connector system presented herein also provides the benefits of reduced manufacturing tooling cost, since only one set of manufacturing tools for the male connector and one set of manufacturing tools for the female connector are needed.

Figure 1:
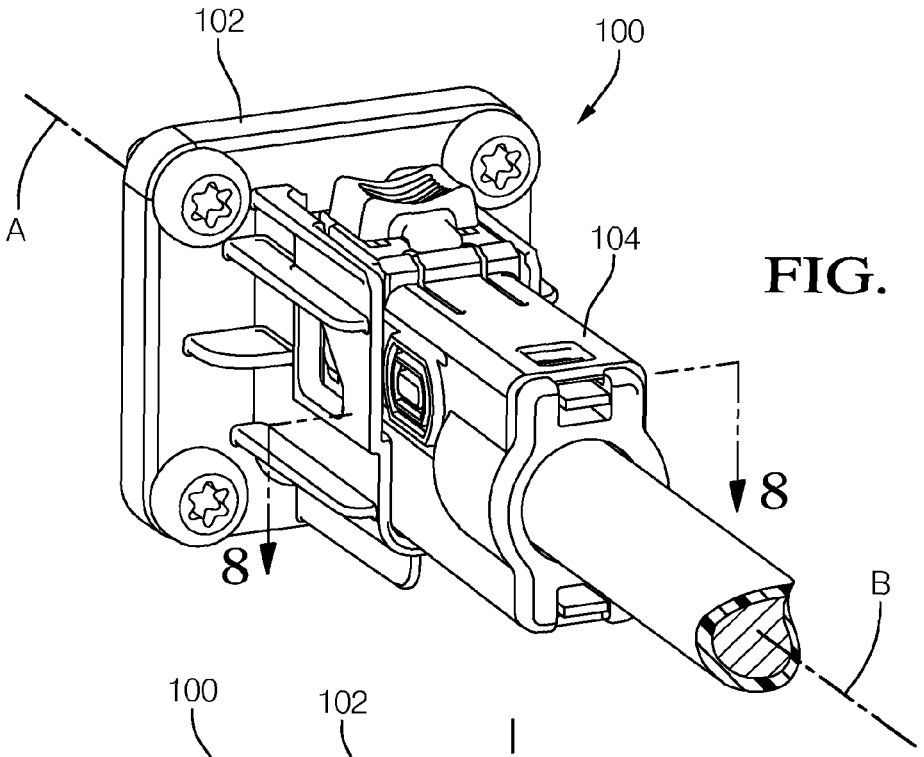
FIG. 1 is a perspective view of an electrical connector system in a straight connection configuration in accordance with a first embodiment.
Figure 2:
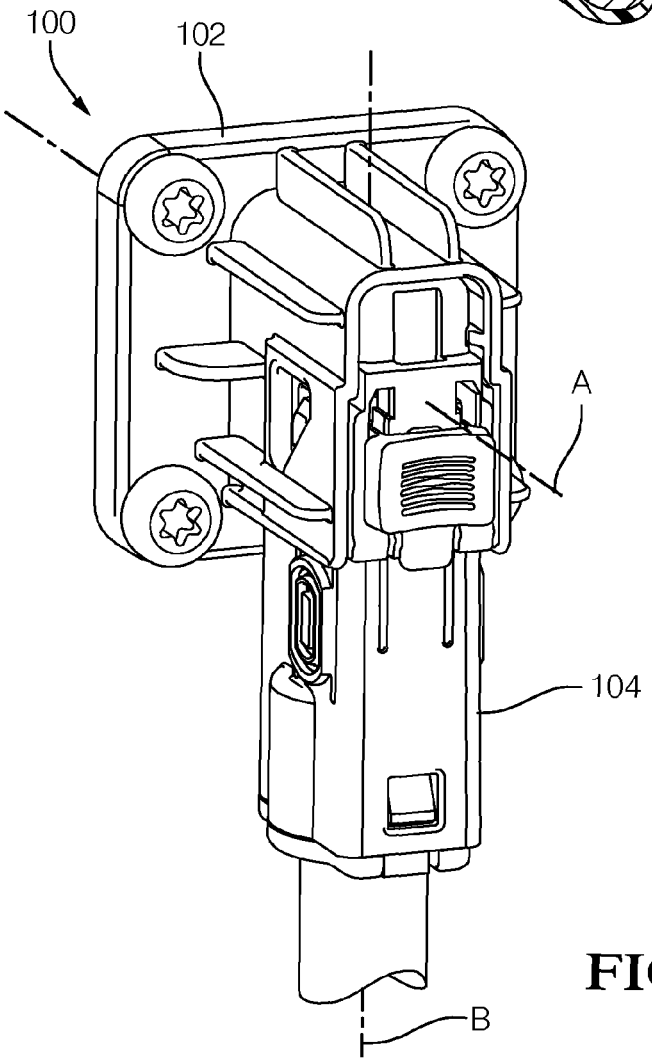
FIG. 2 is a perspective view of the electrical connector system of FIG. 1 in a ninety-degree connection configuration in accordance with the first embodiment.

FIGS. 1 and 2 illustrate a non-limiting example of an electrical connector system 100 that includes a male connector 102 and a female connector 104. The electrical connector system 100 is configured so that the same male connector 102 and female connector 104 may be connected in a straight connection as shown in FIG. 1 or connected in a ninety-degree connection as shown in FIG. 2. As used herein, a straight connection is one in which a male terminal axis A is generally parallel to a female terminal axis B as illustrated in FIG. 1 and a ninety-degree connection is one in which the male terminal axis A is generally perpendicular, or at a ninety-degree angle, from the female terminal axis B. As used herein, generally perpendicular means equal to or less than 30 degrees within absolutely perpendicular and generally parallel means equal to or less 30 degrees within absolutely parallel.

Figure 3:
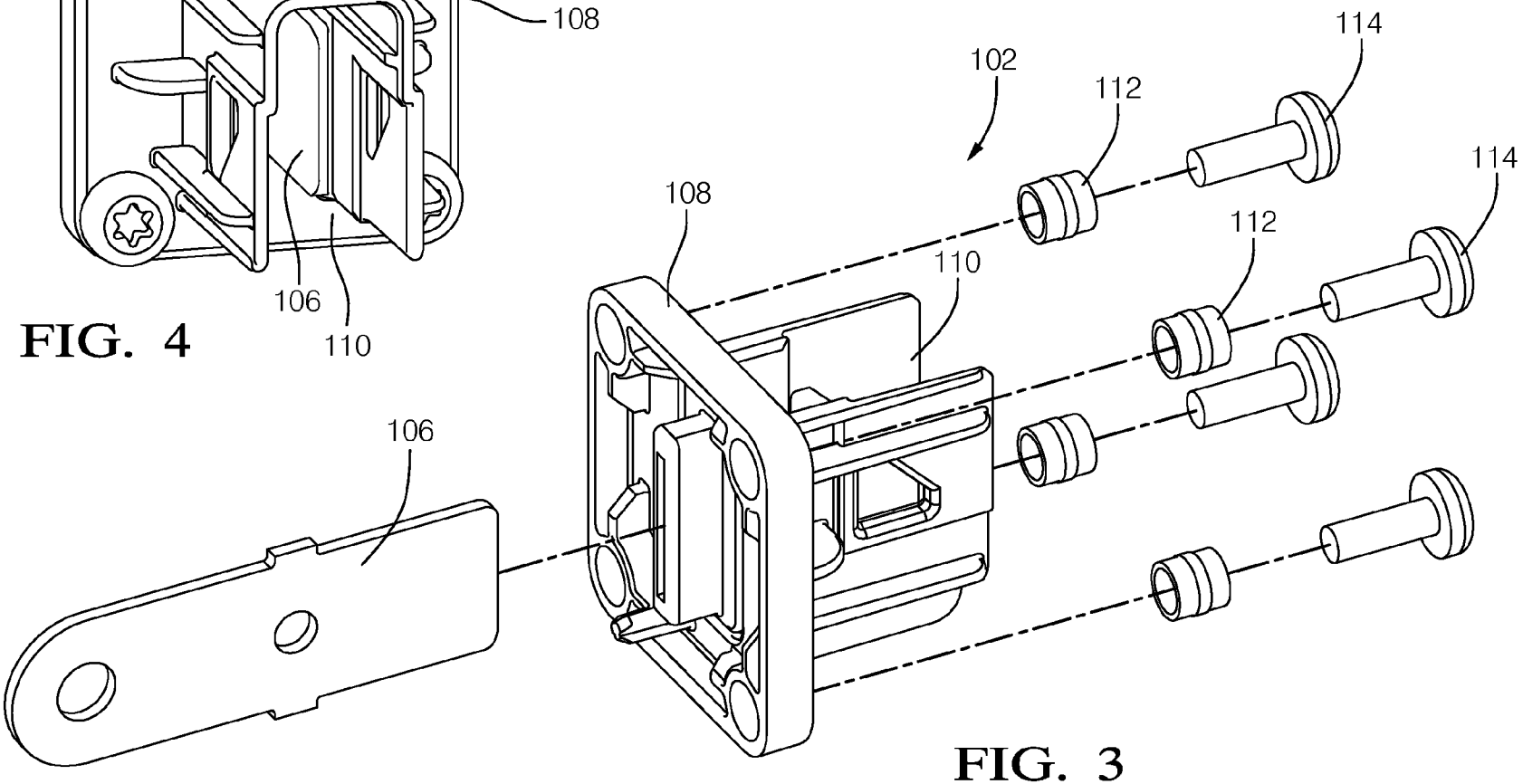
FIG. 3 is an exploded view of a male connector of the electrical connector system of FIG. 1 in accordance with the first embodiment.
Figure 4:
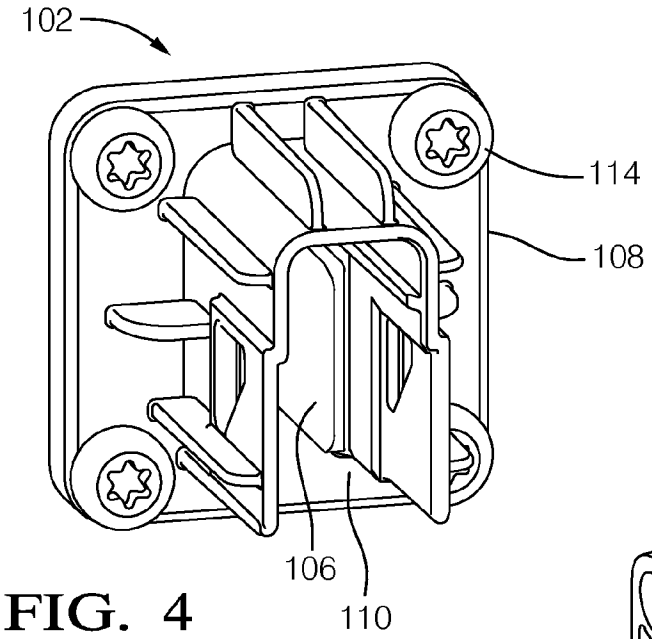
FIG. 4 is an perspective view of the male connector of the electrical connector system of FIG. 1 in accordance with the first embodiment.

FIGS. 3 and 4 illustrate a non-limiting example of the male connector 102. As shown in this exploded view, the male connector 102 includes a male blade terminal 106 that is preferably formed of a conductive material having high conductivity, such as a copper alloy.

The male connector also includes an insulative shroud 108 that is configured to hold the male terminal 106. The shroud 108 is formed of a dielectric material such as glass-filled polybutylene terephthalate (PBT). The shroud 108 partially surrounds the male terminal 106. The shroud 108 generally forms a U-shape having an open side 110 so that the shroud 108 will not interfere with the female connector 104 when the female connector 104 and male connector 102 form a ninety-degree connection. The male terminal 106 may be interference press fit or insert molded into the shroud 108. The male terminal 106 may further include inserts 112 for threaded fasteners 114 may be interference press fit or insert molded to secure the male connector 102 to a panel or bulkhead (not shown).

Figure 5:
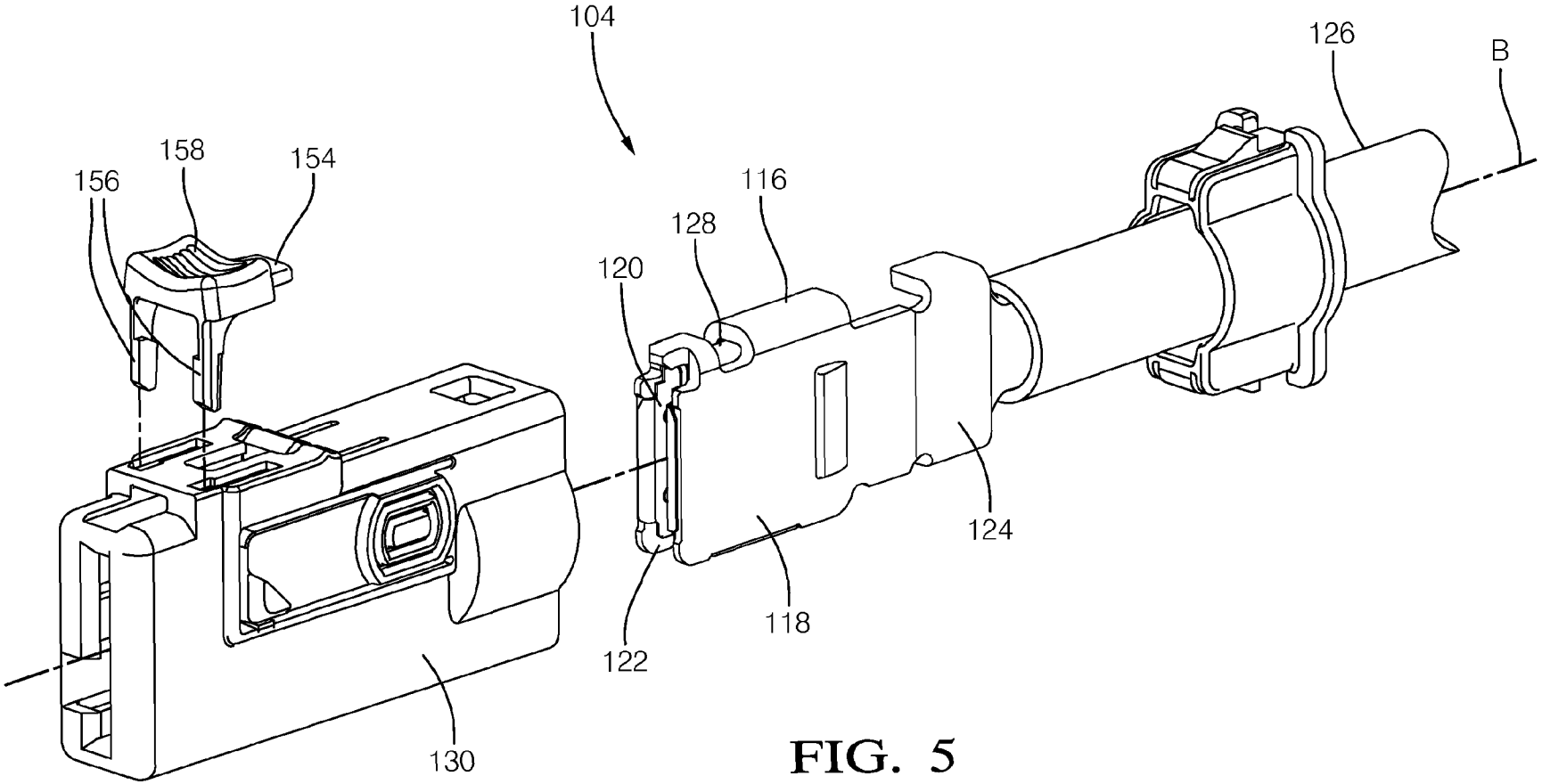
FIG. 5 is an exploded view of a female connector of the electrical connector system of FIG. 1 in accordance with the first embodiment.
Figure 6:
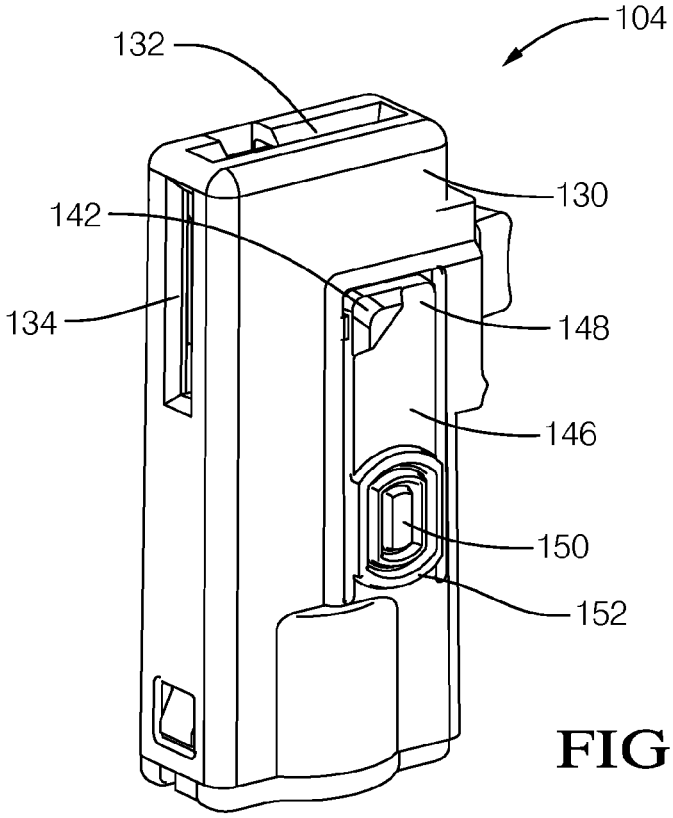
FIG. 6 is a perspective side view of the female connector of the electrical connector system of FIG. 1 in accordance with the first embodiment.

FIGS. 5 and 6 illustrate a non-limiting example of the female connector 104. As shown in this exploded view of FIG. 5, the female connector 104 includes a female terminal 116 that is preferably formed of an electrically conductive material having high conductivity, such as a copper alloy. The female terminal 116 has a mating portion 118 that is configured to mate, i.e. form a mechanical and electrical connection, with the male terminal 106. The mating portion 118 is generally U-shaped having a first opening 120 that is generally parallel to the female terminal axis B and a second opening 122 that is generally perpendicular to the female terminal axis B. The first opening 120 allows the female terminal 116 to mate with the male terminal 106 in a straight connection and the second opening 122 allows the female terminal 116 to mate with the male connector 102 in a ninety-degree connection.

The female terminal 116 also has a cable connection portion 124 that is configured to electrically and mechanically connect the female terminal 116 to a wire cable 126. As shown in the example in FIG. 5, the cable connection portion 124 is configured to be sonically welded to the wire cable 126. Sonically welding the cable to the female terminal 116 provides the benefit of a lower interface resistance between the wire cable 126 and the female terminal 116 and provides the benefit of a shorter terminal length compared to a terminal configured for a crimp connection to the wire cable 126. Alternative embodiments of the female terminal configured for crimp connection to a wire cable may be envisioned since a connector with a crimp connection terminal may provide cost savings in applications that allow a larger terminal and/or higher interface resistance.

The female terminal 116 may also include a terminal insert 128 that is disposed within the U-shaped portion of the female terminal 116. The terminal insert 128 is also generally U-shaped having a first opening that is generally parallel to the female terminal axis B and a second opening that is generally perpendicular to the female terminal axis B. The terminal insert 128 is preferably formed of an electrically conductive material having high conductivity, such as a copper alloy. The terminal insert 128 defines a plurality of fins (not shown) that provide a more forceful interference fit between the female terminal 116 and the male terminal 106.

Figure 7:
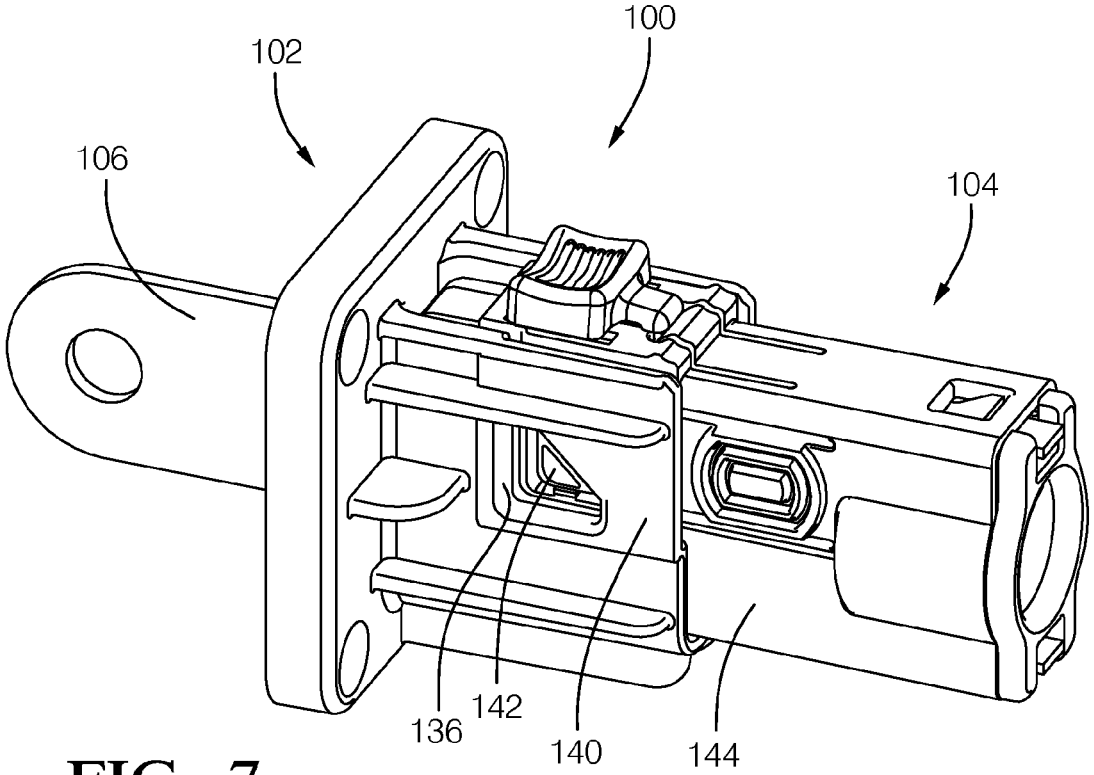
FIG. 7 is a perspective side view of the electrical connector system of FIG. 1 in a straight connection configuration in accordance with the first embodiment.
Figure 8:
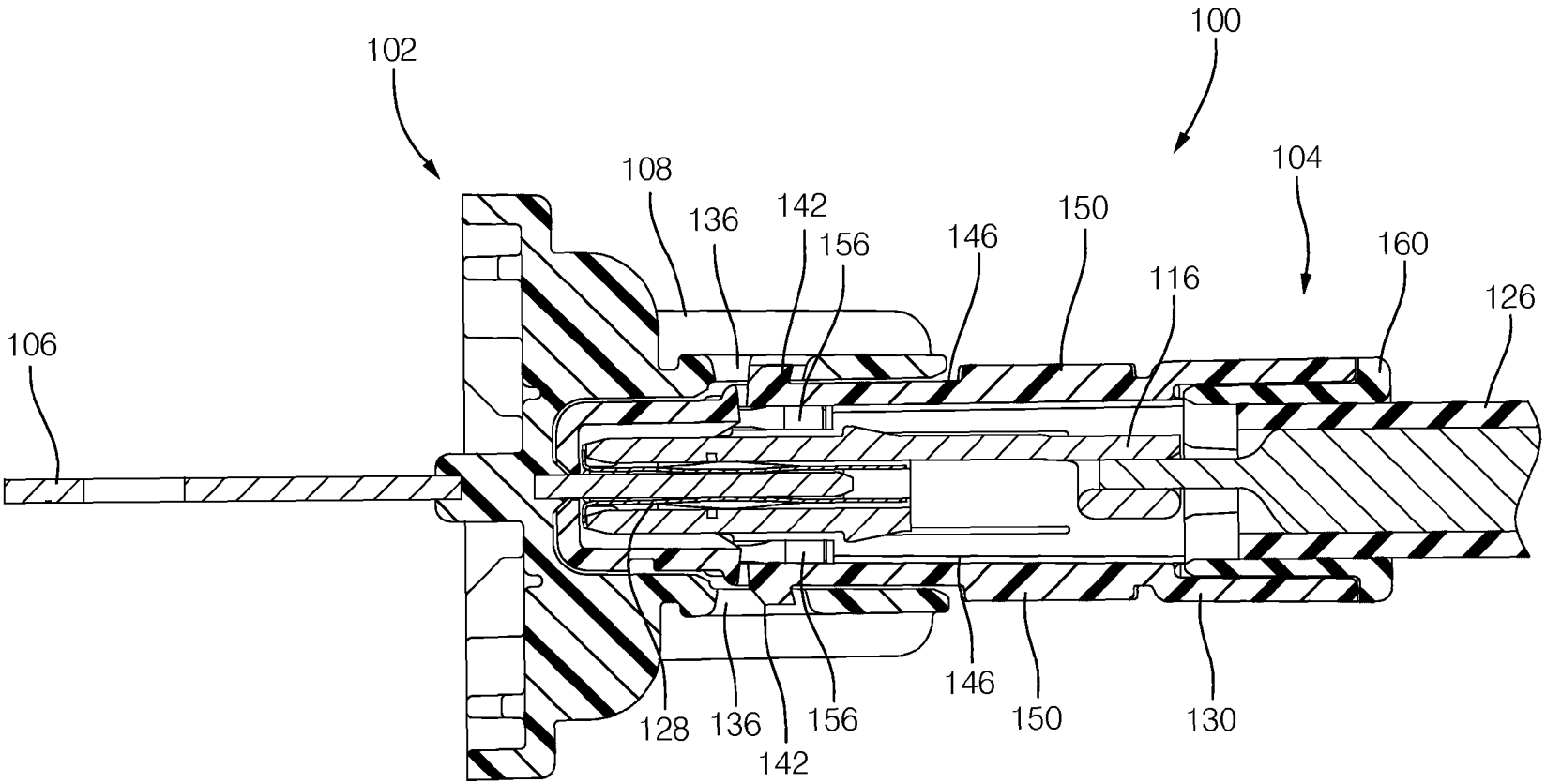
FIG. 8 is a cut-away top view of the electrical connector system of FIG. 1 in a straight connection configuration in accordance with the first embodiment.
Figure 9:
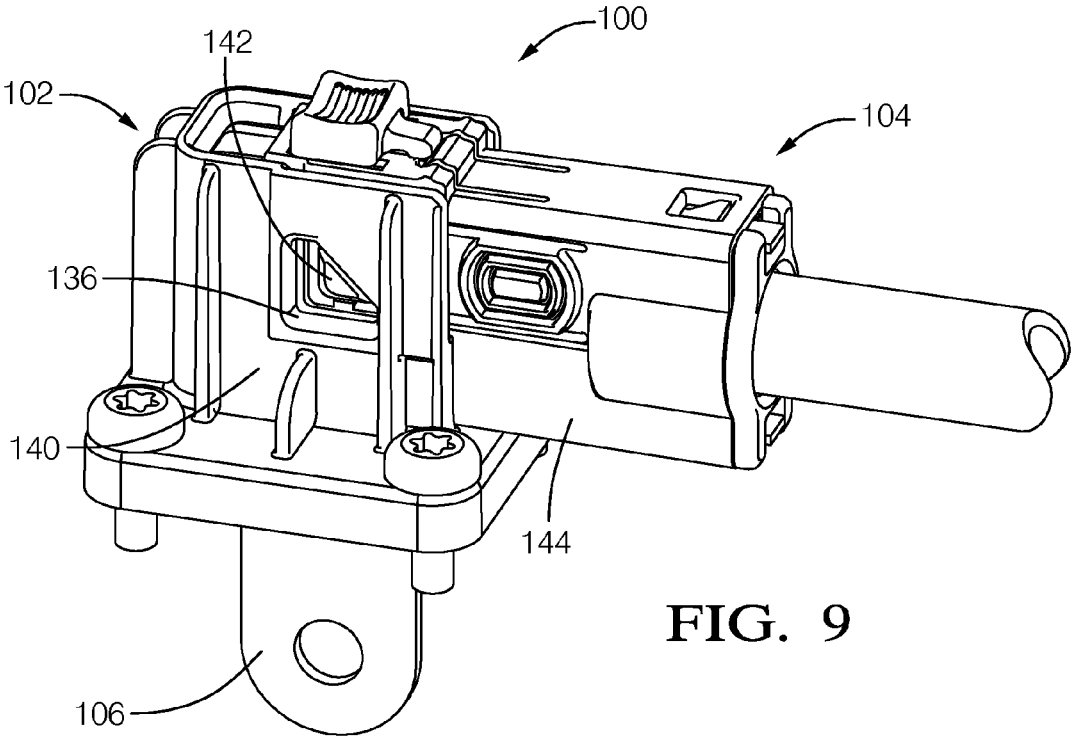
FIG. 9 is a perspective side view of the electrical connector system of FIG. 1 in a ninety-degree connection configuration in accordance with the first embodiment.
Figure 10:
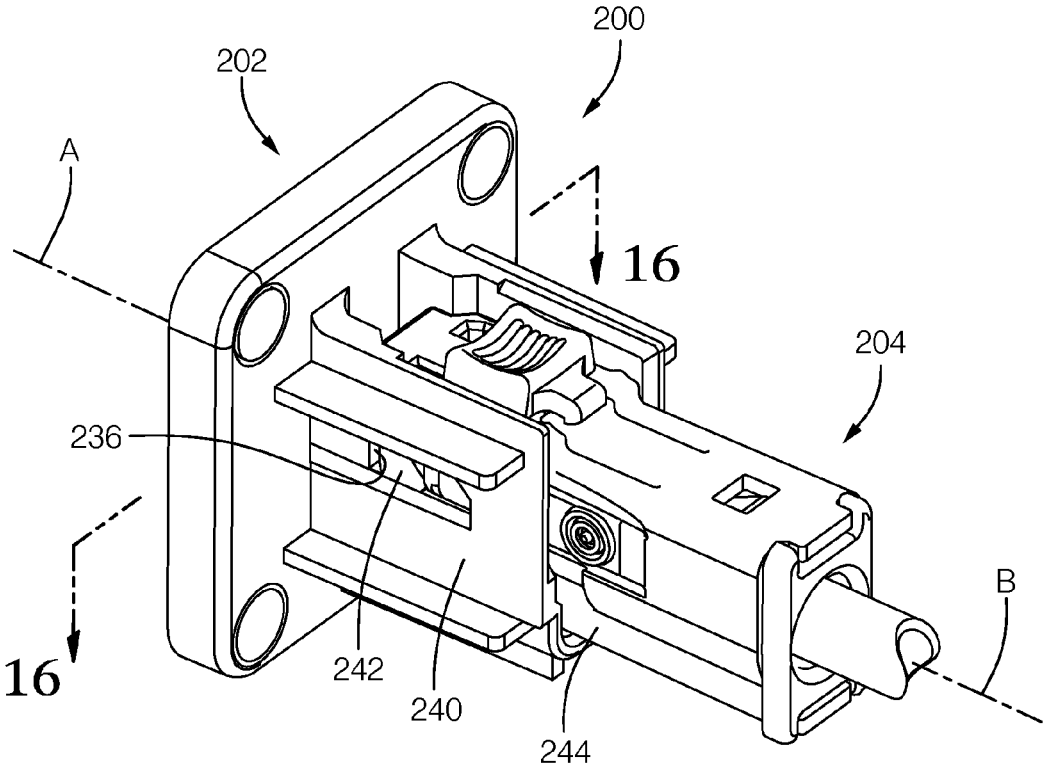
FIG. 10 is a perspective view of an electrical connector system in a straight connection configuration in accordance with a second embodiment.
Figure 11:
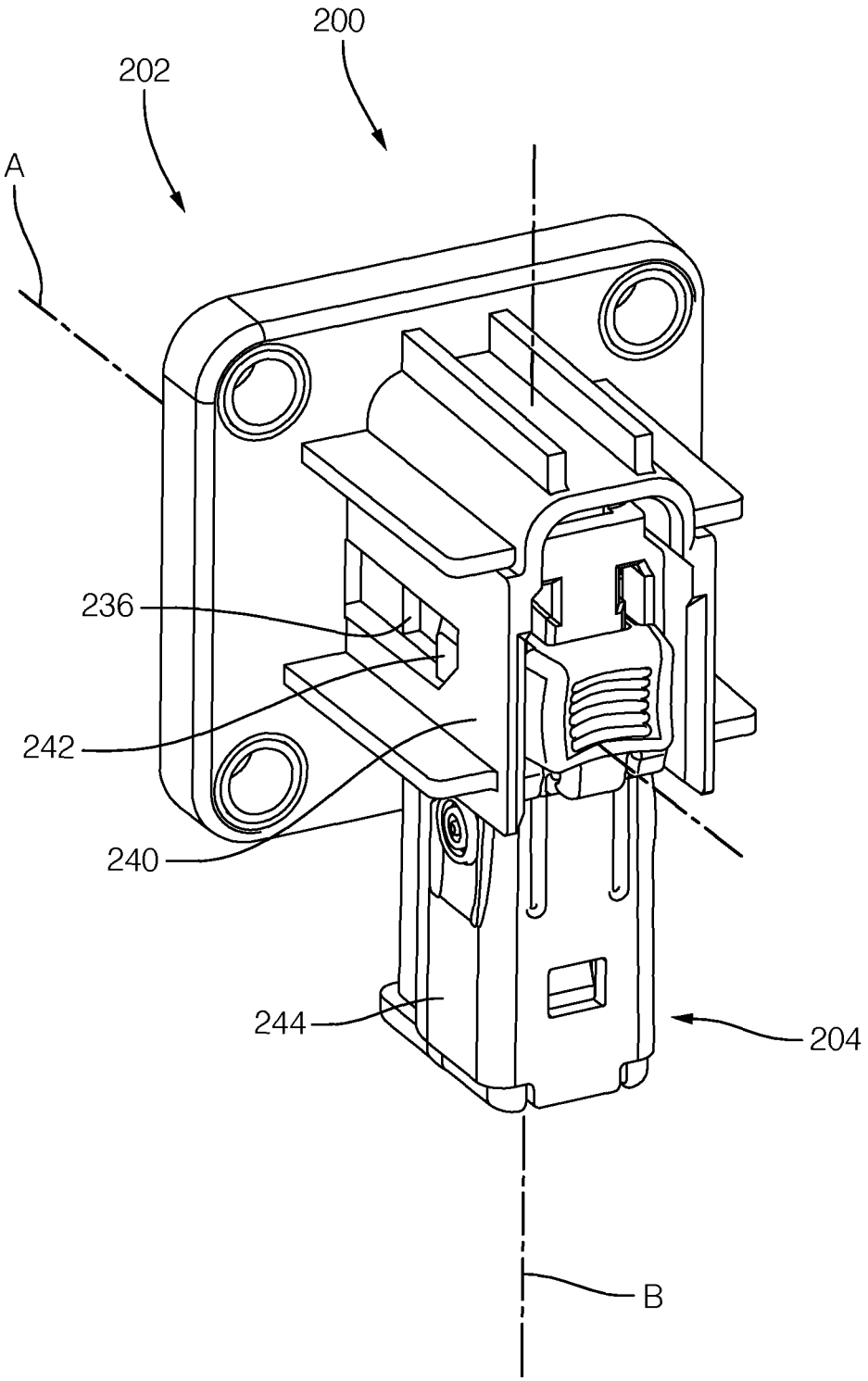
FIG. 11 is a perspective view of the electrical connector system of FIG. 10 in a ninety-degree connection configuration in accordance with the second embodiment.
Figure 12:
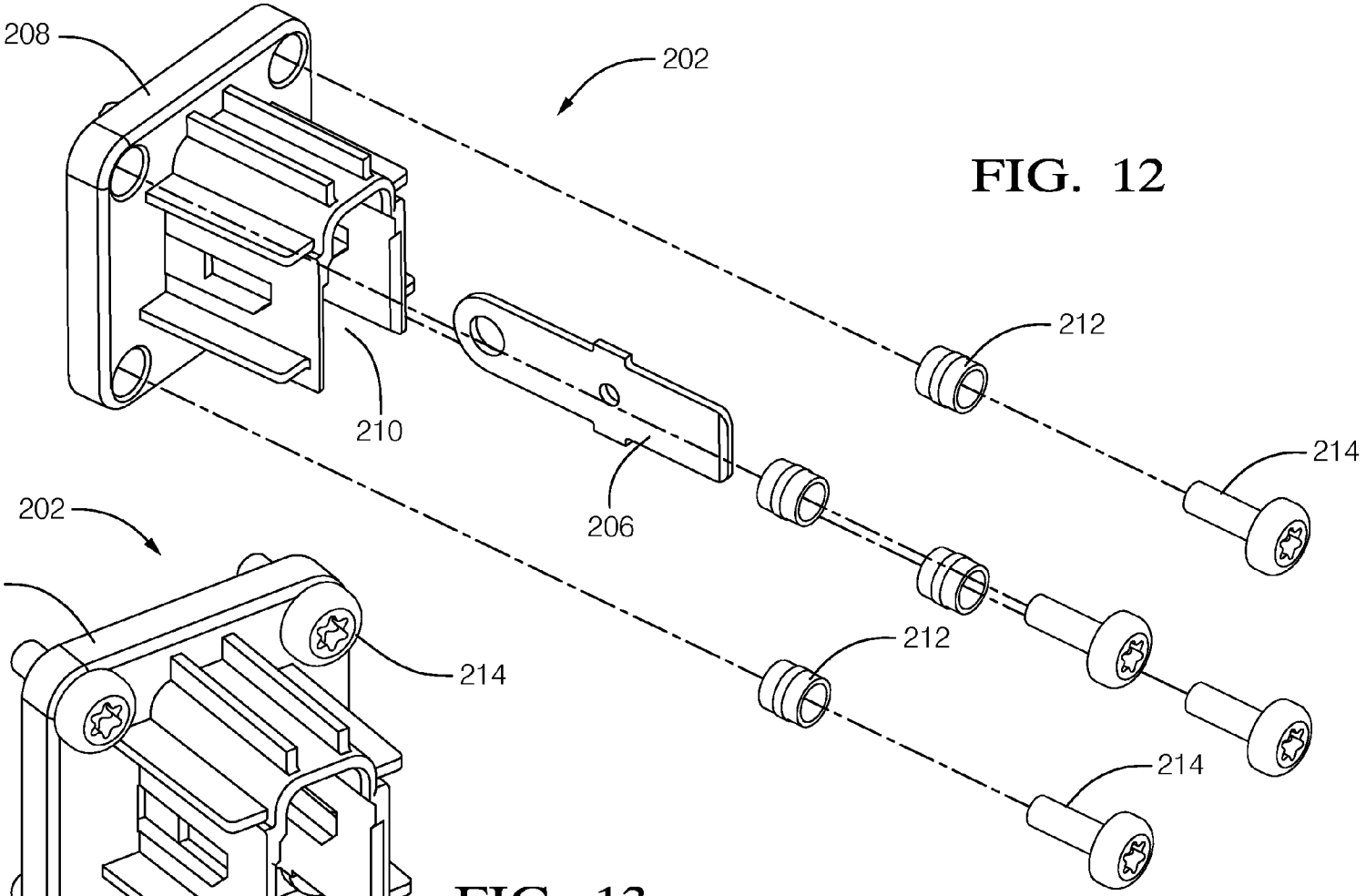
FIG. 12 is an exploded view of a male connector of the electrical connector system of FIG. 10 in accordance with the second embodiment.
Figure 13:
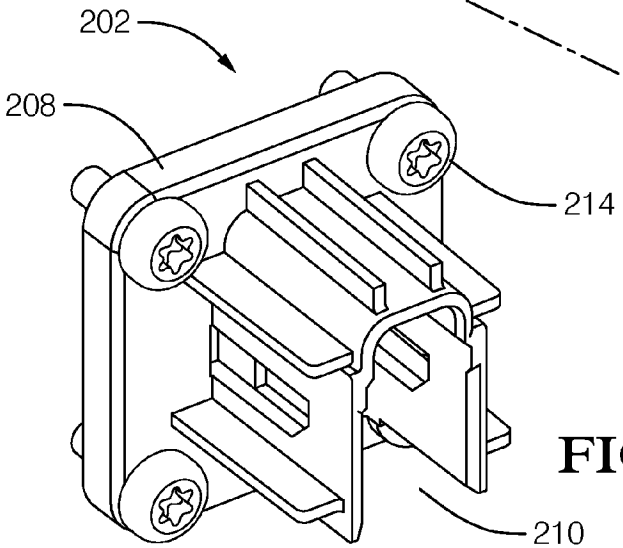
FIG. 13 is an perspective view of the male connector of the electrical connector system of FIG. 10 in accordance with the second embodiment.
Figure 14:
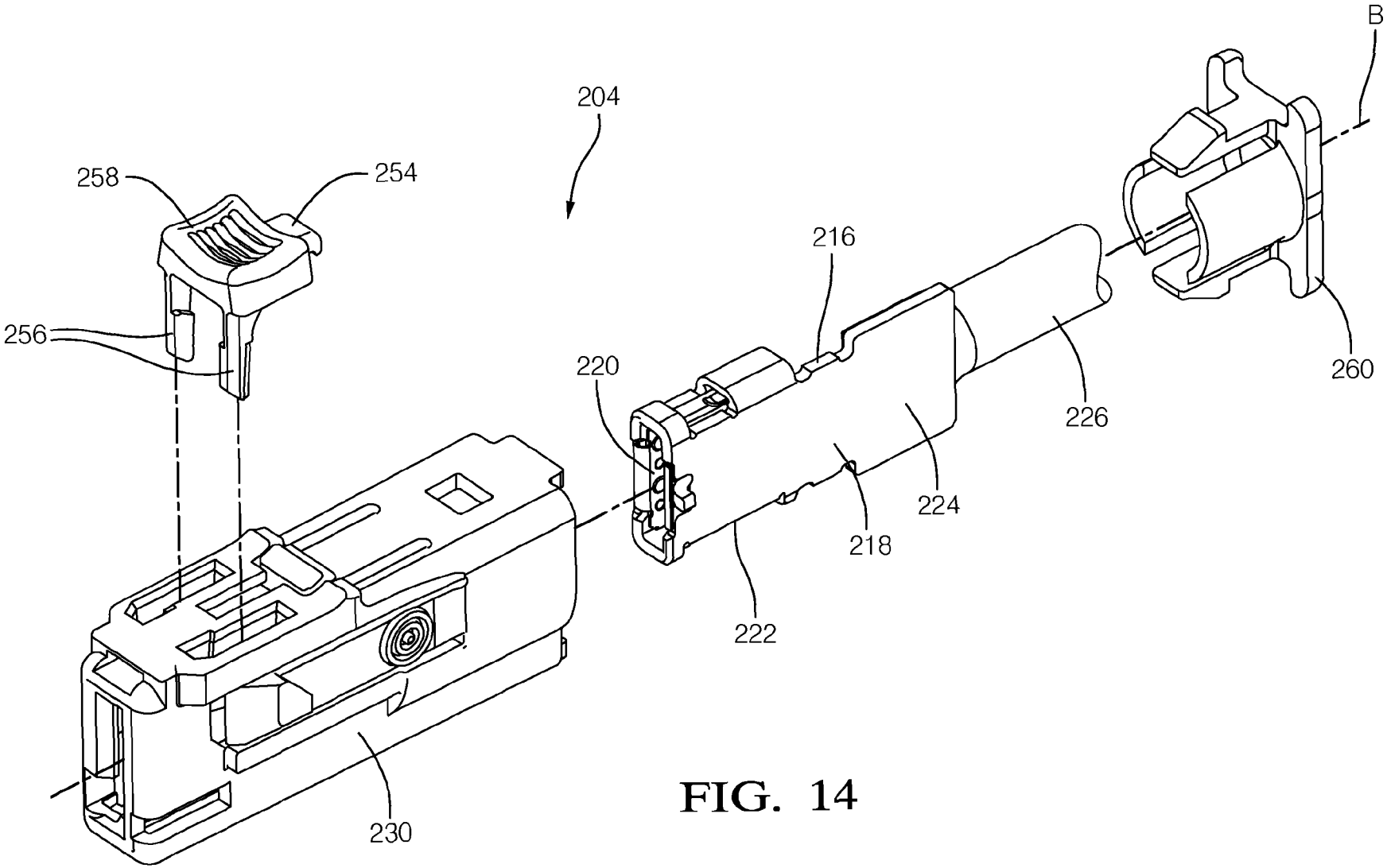
FIG. 14 is an exploded view of a female connector of the electrical connector system of FIG. 10 in accordance with the second embodiment.
Figure 15:
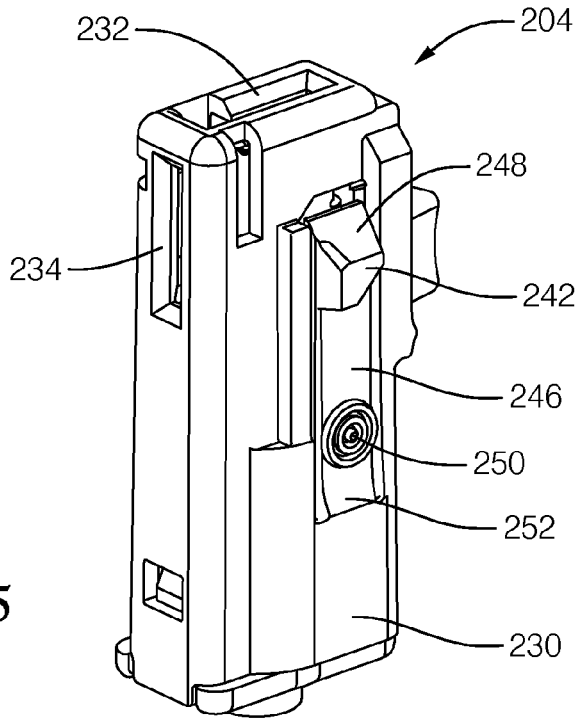
FIG. 15 is a perspective side view of the female connector of the electrical connector system of FIG. 10 in accordance with the second embodiment.
Figure 16:
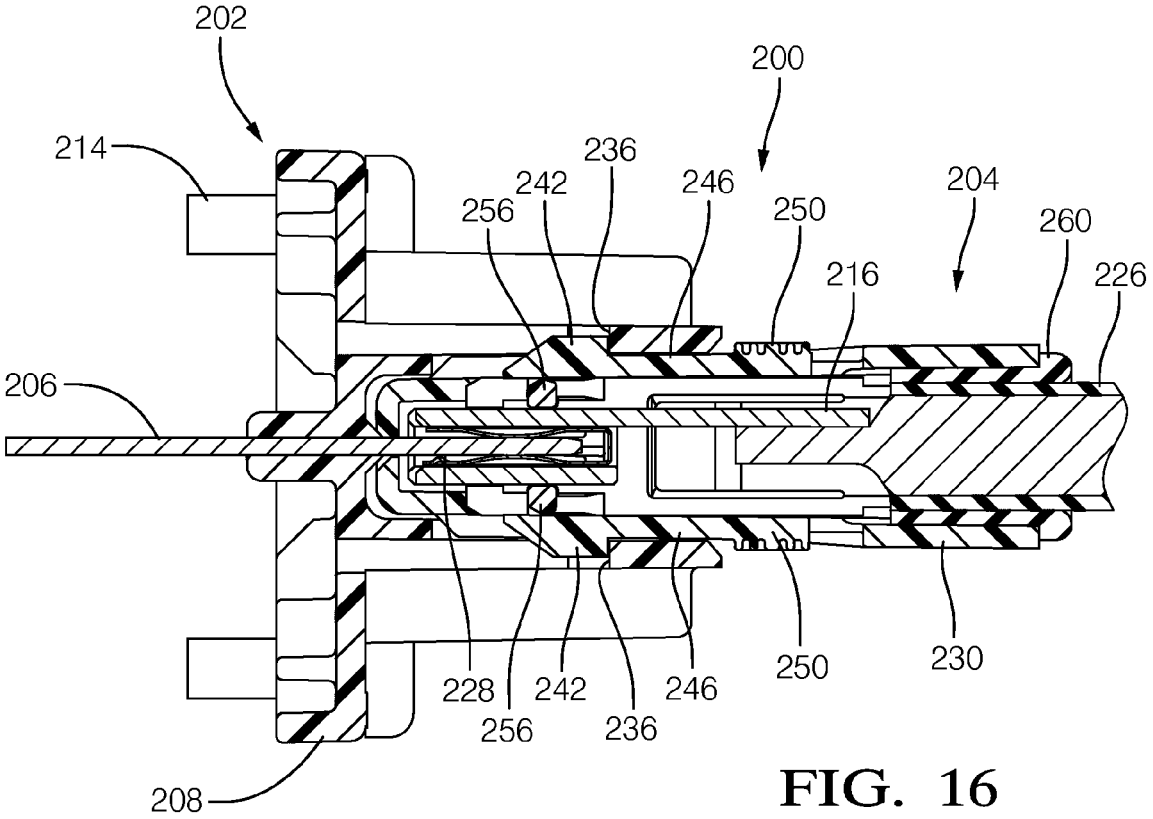
FIG. 16 is a cut-away top view of the electrical connector system of FIG. 10 in a straight connection configuration in accordance with the second embodiment.

The female connector 104 also includes an insulative connector body 130 that surrounds and houses the female terminal 116. The connector body 130 is formed of a dielectric material, such as glass-filled PBT. As illustrated in FIG. 6, the connector body 130 has two terminal openings or slots. The first terminal slot 132 shown in FIG. 6 is generally aligned with the first opening 120 of the female terminal 116, allowing the male terminal 106 to mate with the female terminal 116 when connectors form a straight connection. The second terminal slot 134 shown in FIG. 7 is generally aligned with the second opening 122 of the female terminal 116, allowing the male terminal 106 to mate with the female terminal 116 when connectors form a ninety-degree connection.

As illustrated in FIGS. 5-9, the male connector and female connectors 102, 104 also include a connector position assurance (CPA) device to assure that the male terminal 106 and the female terminal 116 are fully mated when the male and female connectors 102, 104 are connected and to assure that the connectors do not become inadvertently disconnected. The CPA device comprises a pair of lock apertures 136 in the side walls 140 of the shroud 108 and a pair of lock tabs 142 on the side walls 144 of the connector body 130. The lock apertures 136 and lock tabs 142 are configured so that they are not fully engaged until the male and female terminals 106, 116 are fully mated. Once the male and female terminals 106, 116 are fully mated, the outer edges of the lock tabs 142 will engage the inner edges of the lock apertures 136, inhibiting relative motion between the male and female connectors 102, 104. As best shown in FIG. 6, the CPA device also includes a cantilever beam 146 that is defined in both side walls 144 of the connector body 130. One of the pair of lock tabs 142 is located on each cantilever beam 146 near the free end 148 of the cantilever beam 146. A raised or "button" portion 150 is located on the cantilever beam 146 near the fixed end 152 of the cantilever beam 146. When the female connector 104 is mated with the male connector 102, an operator may grasp the female connector 104 by the button portion 150, thereby flexing the cantilever beam 146 inward so that the lock tabs 142 clear the interior of the side walls 140 of the shroud 108 as the female connector 104 is inserted into the male connector 102. After the lock tabs 142 are inserted into the shroud 108, the operator may release the button portion 150. As the female connector 104 is further inserted into the male connector 102, the trailing edge of the lock tab 142 will clear the edges of the opening at which point the cantilever beam 146 will snap the lock tab 142 into place within the opening. This may produce an audible and/or tactile "click" that may provide feedback to the operator that the male and female connectors 102, 104 are fully engaged.

As shown in FIG. 5, the CPA also includes a lock tab 154 that is configured to inhibit inward movement of the cantilever beam 146. The lock tab 154 includes a pair of arms 156 that are disposed between the inner walls of the connector body 130 and the female terminal 116. The arms 156 are connected to a thumb tab 158 that allows the arms 156 to be moved within the connector body 130. Before the female connector 104 is inserted into the shroud 108 of the male connector 102, the arms 156 are moved by the thumb tab 158 to a position wherein the arms 156 are not between cantilever beam 146 and the female terminal 116, allowing the cantilever beam 146 to flex inward when an operator presses on the button portion 150. After the connectors are mated, the arms 156 are moved by the thumb tab 158 to a position wherein the arms 156 are between the cantilever beam 146 and the female terminal 116, preferably near the free end 148 of the cantilever beam 146, thereby inhibiting the cantilever beam 146 from flexing inward and securing the lock tabs 142 within the lock apertures 136.

The lock tabs 142 and the lock apertures 136 have a shape that has 90 degrees of rotational symmetry, such as a square, rhombus, circle, octagon, isosceles right triangle, X, or cross, so that the lock tabs 142 may engage with the lock apertures 136 in the shroud 108 in either a straight connection or a ninety-degree connection.

The female connector 104 may also include a terminal position assurance (TPA) device 160 that is configured to assure that the female terminal 116 is fully seated within the connector body 130 when the female terminal 116 is inserted into the connector body 130.

While the embodiments of this invention shown in the Figures illustrate a male connector 102 configured for panel mounting and a female connector 104 configured to be attached to a cable end, alternate embodiments of this invention may be envisioned in which the male connected is cable mounted or the female connector is panel mounted.

Further, the embodiments shown in the Figures illustrate an electrical connector system having a single set of male and female terminals. Other embodiments of this invention may be envisioned having multiple sets of male and female terminals. Still other embodiments of the invention may be envisioned to connect fiber optic cables, pneumatic hoses, or fluid carrying hoses.

FIGS. 10-16 illustrate another embodiment of an electrical connector system 200 that may be used in applications requiring a lower current carrying capability than the electrical connector system 100. Elements of the electrical connector system 200 that are similar to the elements of electrical connector system 100 share the last two digits of the reference number.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector system comprising:

a male connector that includes a male terminal, and a U-shaped shroud axially surrounding the male terminal, wherein the shroud defines an opening generally perpendicular to a male terminal longitudinal axis; and a female connector that includes a female terminal defining a first terminal opening generally parallel with a female terminal longitudinal axis and a second terminal opening generally perpendicular to the female terminal longitudinal axis, wherein the female terminal is configured to mate with the male terminal in a parallel mating configuration having the male terminal longitudinal axis generally parallel to the female terminal longitudinal axis and wherein the female terminal is configured to mate with the male terminal in a perpendicular mating configuration having the male terminal longitudinal axis generally perpendicular to the female terminal longitudinal axis, and a connector body holding the female terminal, wherein the connector body defines a locking means configured to releasably secure the connector body to the shroud in the parallel mating configuration and in the perpendicular mating configuration.

2. The electrical connector system of claim 1, wherein the shroud defines a lock aperture and wherein the locking means includes a resilient lock tab configured to engage the lock aperture, thereby securing the connector body to the shroud in the parallel mating configuration and in the perpendicular mating configuration.

3. The electrical connector system, of claim 2, wherein the lock tab defines a shape having 90 degrees of rotational symmetry.

4. The electrical connector system of claim 3, wherein the lock tab and the lock aperture are characterized as having a generally isosceles right triangle shape.

5. The electrical connector system of claim 2, wherein the connector body includes a resilient cantilever beam defining the lock tab.

6. The electrical connector system of claim 5, wherein the connector body further comprises a connector position assurance device including an arm configured to slide behind the cantilever beam, thereby inhibiting inward flexing of said cantilever beam.

7. The electrical connector system of claim 5, wherein the lock tab is proximate a free end of the cantilever beam.

8. A female connector configured to interconnect with a mating male connector having a male terminal defining a male terminal longitudinal axis and a U-shaped shroud axially surrounding the male terminal and defining a lock aperture, the female connector comprising:

a female terminal defining a first terminal opening generally parallel with a female terminal longitudinal axis and a second terminal opening generally perpendicular to the female terminal longitudinal axis, wherein the female terminal is configured to mate with the male terminal in a parallel mating configuration having the male terminal longitudinal axis generally parallel to the female terminal longitudinal axis and wherein the female terminal is configured to mate with the male terminal in a perpendicular mating configuration having the male terminal longitudinal axis generally perpendicular to the female terminal longitudinal axis; and a connector body holding the female terminal, wherein the connector body defines a locking means configured to engage the lock aperture, thereby securing the connector body to the shroud in the parallel mating configuration and in the perpendicular mating configuration.

9. The female connector of claim 8, wherein the locking means includes a resilient lock tab configured to engage the lock aperture, thereby securing the connector body to the shroud in the parallel mating configuration and in the perpendicular mating configuration.

10. The female connector of claim 9, wherein the lock tab defines a shape having 90 degrees of rotational symmetry.

11. The female connector of claim 10, wherein the lock tab is characterized as having a generally isosceles right triangle shape.

12. The female connector of claim 9, wherein the connector body includes a resilient cantilever beam defining the lock tab.

13. The female connector of claim 12, wherein the connector body further comprises a connector position assurance device including an arm configured to slide behind the cantilever beam, thereby inhibiting inward flexing of said cantilever beam.

14. The female connector of claim 12, wherein the lock tab is proximate a free end of the cantilever beam.

15. A male connector configured to interconnect with a mating female connector having a lock tab configured to releasably secure the mating female connector to the male connector in a parallel mating configuration and in a perpendicular mating configuration, said male connector comprising:

a male terminal; and a U-shaped shroud axially surrounding the male terminal, wherein the shroud defines an opening generally perpendicular to a male terminal longitudinal axis configured to receive the lock tab; wherein the lock aperture defines a shape having 90 degrees of rotational symmetry.

16. The male connector of claim 15, wherein the lock aperture is characterized as having a generally isosceles right triangle shape.

* * * * *